US009237774B2

(12) United States Patent
Ziegler

(10) Patent No.: US 9,237,774 B2
(45) Date of Patent: Jan. 19, 2016

(54) CLADDING ELEMENT MADE OF CHAIN MAIL

(71) Applicants: Ziegler Arbeitsschutz GmbH, Mühlacker (DE); Jörg Peitzker, Mönchengladbach (DE)

(72) Inventor: Jürgen Ziegler, Mühlacker (DE)

(73) Assignees: ZIEGLER ARBEITSSCHUTZ GMBH, Mühlacker (DE); JOERG PEITZKER, Mönchengladbach (DE)

( * ) Notice: Subject to any disclaimer, the term of this patent is extended or adjusted under 35 U.S.C. 154(b) by 0 days.

(21) Appl. No.: 14/389,316

(22) PCT Filed: Mar. 27, 2013

(86) PCT No.: PCT/EP2013/000918

§ 371 (c)(1),
(2) Date: Sep. 29, 2014

(87) PCT Pub. No.: WO2013/143691

PCT Pub. Date: Oct. 3, 2013

(65) Prior Publication Data

US 2015/0048216 A1 Feb. 19, 2015

(30) Foreign Application Priority Data

Mar. 29, 2012 (DE) ..... 10 2012 006 279

(51) Int. Cl.
*A41D 13/015* (2006.01)
*A41D 31/00* (2006.01)
(Continued)

(52) U.S. Cl.
CPC ..... *A41D 31/0005* (2013.01); *A41D 19/01511* (2013.01); *A41D 19/02* (2013.01)

(58) Field of Classification Search
CPC ..... A41D 13/0153; A41D 19/01511; A41D 31/0005; A41D 31/0055; A41D 13/015; A41D 13/043; A41D 19/01505; A41D 19/01517; A41D 19/01588; A41D 19/02; B32B 7/08; B32B 2262/103; B32B 2307/581; B32B 2437/00; B32B 3/02; B32B 3/18; F41H 1/02; F41H 5/0492; F41H 5/0457; F41H 5/007; F41H 5/013; F41H 5/04; A63B 2071/1258; A63B 71/1225; A63B 21/055; A63B 21/065; A63B 21/1411; A63B 21/1415; A63B 21/1434; B29L 2031/768; A43B 13/10; A43B 17/003
See application file for complete search history.

(56) References Cited

U.S. PATENT DOCUMENTS 3,812,540 A * 5/1974 Pagano ..... 2/93
4,284,065 A * 8/1981 Brill-Edwards ..... 126/668
(Continued)

FOREIGN PATENT DOCUMENTS

DE 35 33 894 A1 5/1986
EP 0 758 854 A1 2/1997
EP 0 948 909 A1 10/1999

*Primary Examiner* — Bobby Muromoto, Jr.
(74) *Attorney, Agent, or Firm* — Rabin & Berdo, P.C.

(57) ABSTRACT

A cladding element is formed from chain mail for cladding forms having different radii with the chain mail. For this purpose, the chain mail has at least one cut, which is connected at the edges thereof or to the edges of a further cut in order to clad the form. The chain mail has a running direction, in which the chain mail can be stretched to a substantially smaller degree, or cannot be stretched at all, compared to a direction running transversely thereto, preferably at a right angle. Because the chain mail with the running direction is arranged along an arc of the form specified by the radius and has indentations transversely to the running direction, wherein the connection takes place particularly along the edges of the cuts, three-dimensional round forms such as spheres or annular shapes or the segments thereof are clad efficiently.

20 Claims, 7 Drawing Sheets

(51) Int. Cl.

| | |
|---|---|
| ***A41D 19/015*** | (2006.01) |
| *A41D 13/00* | (2006.01) |
| *A41D 19/02* | (2006.01) |

(56) References Cited

U.S. PATENT DOCUMENTS

| | | | | | |
|---|---|---|---|---|---|
| 4,356,569 | A | * | 11/1982 | Sullivan | 2/2.5 |
| 4,791,236 | A | * | 12/1988 | Klein et al. | 174/36 |
| 4,802,242 | A | | 2/1989 | Lars-Jos | |
| 5,729,831 | A | | 3/1998 | Kuhlmann | |
| 5,857,216 | A | | 1/1999 | Gold | |
| 5,943,694 | A | * | 8/1999 | Moureaux et al. | 2/2.5 |
| 6,381,753 | B1 | | 5/2002 | Smith et al. | |
| 6,484,468 | B2 | * | 11/2002 | Thompson | 52/511 |
| 6,907,310 | B2 | * | 6/2005 | Gardner et al. | 700/132 |
| 7,984,591 | B2 | * | 7/2011 | Cashin et al. | 52/63 |
| 7,992,325 | B2 | * | 8/2011 | Walworth et al. | 36/72 R |
| 2004/0049309 | A1 | * | 3/2004 | Gardner et al. | 700/132 |
| 2004/0261953 | A1 | * | 12/2004 | Hart | 160/80 |
| 2007/0028351 | A1 | * | 2/2007 | Coolik | 2/115 |
| 2008/0115387 | A1 | * | 5/2008 | Walworth et al. | 36/132 |
| 2009/0229531 | A1 | * | 9/2009 | Stillman | 119/215 |
| 2011/0023201 | A1 | * | 2/2011 | Pearl et al. | 2/2.5 |
| 2014/0150154 | A1 | * | 6/2014 | Aquino | 2/2.5 |

* cited by examiner

CLADDING ELEMENT MADE OF CHAIN MAIL

RELATION TO RELATED APPLICATIONS

The present application claims priority from German patent application 10 2012 006 279.6, filed on 29 Mar. 2012, the disclosure of which is also herewith expressly made the subject of the present application.

FIELD OF THE INVENTION

The invention relates to a cladding element made of chain mail, for cladding shapes having different radii, according to the preamble of Claim 1.

PRIOR ART

Chain mail is widely used, usually to protect the elements clad therewith, for example even to protect parts of the body from injury. Typically, the chain mail thus fulfils a protective function against pointed or sharp objects, as for example also in the case of the protective glove according to EP 0 758 854 B1, which forms the basis of the preamble of Claim 1. It is known from this specification that, as a result of its manufacture, a chain mail material has two directions of extent, wherein the chain mail is substantially less stretchable in one direction of extent—or is not stretchable at all—than in a transverse direction which preferably extends at a right angle thereto. This principle is used in that case in the context of a closing strip that is consequently less capable of being folded up.

DE 35 33 894 A1 discloses cladding elements made of chain mail for cladding shapes having different radii, wherein the direction of extent of the material is changed depending on the desired stretch. There is no correlation between the chain mail and arcs.

OBJECT OF THE INVENTION

Taking as a starting point this prior art, the object of the present invention is to clad three-dimensional round shapes such as spheres or annular shapes or segments thereof, in efficient manner.

This object is achieved by a cladding element having the features of Claim 1.

The invention makes use of the direction of extent, wherein the direction of extent in which the chain mail is less stretchable or, preferably, is not stretchable at all is arranged along an arc, while indentations are provided transversely thereto. In fact, when moving over the outside of a three-dimensional rounded or spherical body, as a large radius is replaced by smaller and smaller radii, the material is gathered up more and more. Once the maximum possible gathering is reached, however, the material bunches and can no longer be laid taut around the shape. By providing indentations or recesses, or by removing material, however, it is ensured that the shape can be covered in a taut arrangement. Shapes of this kind can then be used for the greatest variety of purposes, including for example architectonic purposes or design elements, since the balanced combination of direction of extent makes it possible to precisely follow the curvatures of the shape. For example, it is possible to clad loops in cables, arcs in hoses, corners and curves in pipes, corners of furniture, shoulder heads on garments, mittens, overshoes, knee or elbow pads, parts of socks, abstract designs, shrimping nets, collecting bags, pouches or similar products where these half-round or spherical shapes occur.

For manufacture, as few parts as possible are to be used as blanks, since these have still to be joined together in cladding the shape. The indentations and notches make this possible without problems, since notches of this kind can where necessary be positioned one after the other, such that shapes of entire circles can be clad with the chain mail. For this reason, the blanks preferably comprise a single or two parts.

Preferably, the direction of extent of the chain mail that is less stretchable or in which it cannot be stretched at all is arranged around the arc whereof the radius is typically the larger or largest. As a result, a support function may be generated there by the arrangement of the direction of extent, and the other blank parts associated therewith may be oriented to this such that the desired abutment of the material against the basic shape is produced.

With certain shapes, it is necessary to flatten the blank in the region of the indentations, or rather between the indentations, such that optimum shaping is made possible. For this purpose, there may be formed between the indentations a trapezoidal shape whereof the upper side lies below the upper edge points of the indentations.

Further advantages will become apparent from the subclaims and the description which follows of preferred exemplary embodiments.

BRIEF DESCRIPTION OF THE DRAWINGS

The invention will be explained in more detail below with reference to a number of exemplary embodiments. The Figures show.

DETAILED DESCRIPTION OF PREFERRED EXEMPLARY EMBODIMENTS

The invention will now be explained in more detail by way of example with reference to the attached drawings. However, the exemplary embodiments are merely examples, which are not intended to restrict the inventive concept to a particular arrangement.

Before the invention is described in detail, it should be pointed out that it is not restricted to the respective components of the device or the respective method steps, since these components and methods may vary. The terms used here are merely intended to describe particular embodiments and are not used restrictively. Moreover, where the singular or indefinite articles are used in the description or the claims, this also includes the plural of these elements provided the overall context does not unambiguously indicate otherwise.

The Figures show various blanks and shapes that are formed from these, for using chain mail as a cladding element for cladding shapes having different radii with the chain mail. The problem, when cladding round or rounded shapes with chain mail, lies in the fundamental structure of the chain mail. Chain mail has a basic direction of extent in which the chain mail is preferably less stretchable—or is not stretchable at all—than in a further, transverse direction which in particular extends at a right angle thereto. The result is that when cladding round or rounded shapes, in particular if they have different radii, the chain mail has to be gathered up more and more. Once the maximum possible gathering is reached, however, the material bunches and can no longer be laid taut around the shape, which results in corresponding sacrifices from an aesthetic point of view.

For this reason, there are provided in the blanks for 10, 20, 30, 40, 50, 60 and in the further blanks 41, 51 indentations, notches or recesses in order to remove excess material and to ensure that the shape to be clad can be covered in a taut arrangement. If this is done with a balanced combination of direction of extent, the curvature of the shape is precisely followed. In this way, any round and rounded shape, included abstract shapes, can be clad in the greatest variety of areas of use, that is to say including in the sectors of architecture or design. In particular, the following are conceivable: loops in cables, arcs in hoses, corners and curves in pipes, corners of furniture, shoulder heads on garments, mittens, overshoes, knee or elbow pads, parts of socks, abstract designs, shrimping nets, collecting bags, pouches or similar products where half-round or spherical shapes of this kind occur. The blanks are connected to one another by way of their edges 10*a*, 20*a*, 30*a*, 40*a*, 50*a*, 60*a* and at the edges 41*a*, 51*a*, regardless of whether these edges now form the edge of the original blank or the edge of the indentations 12, 22, 32, 42, 52, 62.

Figure 2:
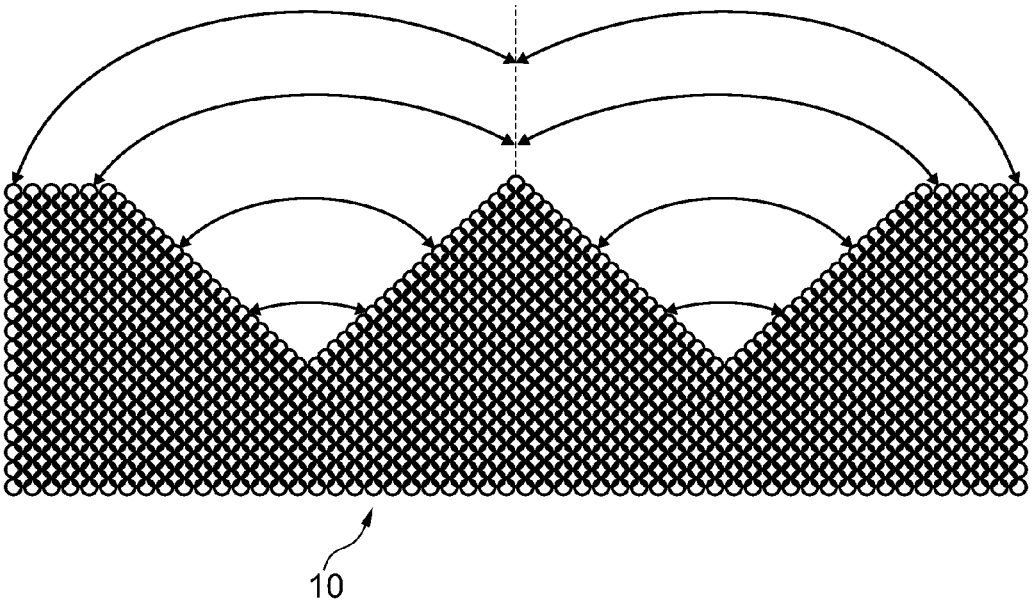
Figure 3:
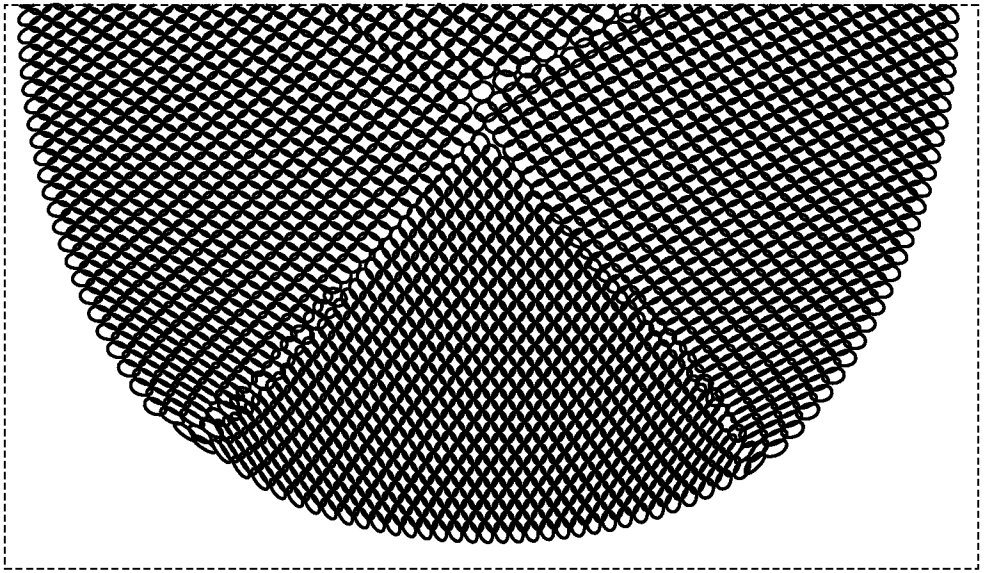

It can be seen from the Figures that preferably a single blank 10, 20, 30, 60 or two blanks 40, 41; 50, 51 are required to clad the rounded shape. The fewer blanks there are, the more efficiently can the three-dimensional rounded shape be clad. To do this, it is in fact necessary for the edges 10*a*, . . . 60*a* to be connected by being sewn together by means of metal rings which preferably have the diameter of the rings of the chain mail. This then gives a shape as illustrated for example in FIG. 3, in which a simple rounded shape is clad by the chain mail. The associated blanks for cladding a shape of this kind, which is rounded out on one side, can be found in FIG. 1. It can be clearly seen from the blank 10 in FIG. 1 that there is a direction of extent L, with the indentations 12 arranged transversely thereto. In FIG. 2, as illustrated by the arrows, the indentations are then connected or sewn to one another, to give the shape according to FIG. 3.

Figure 4:
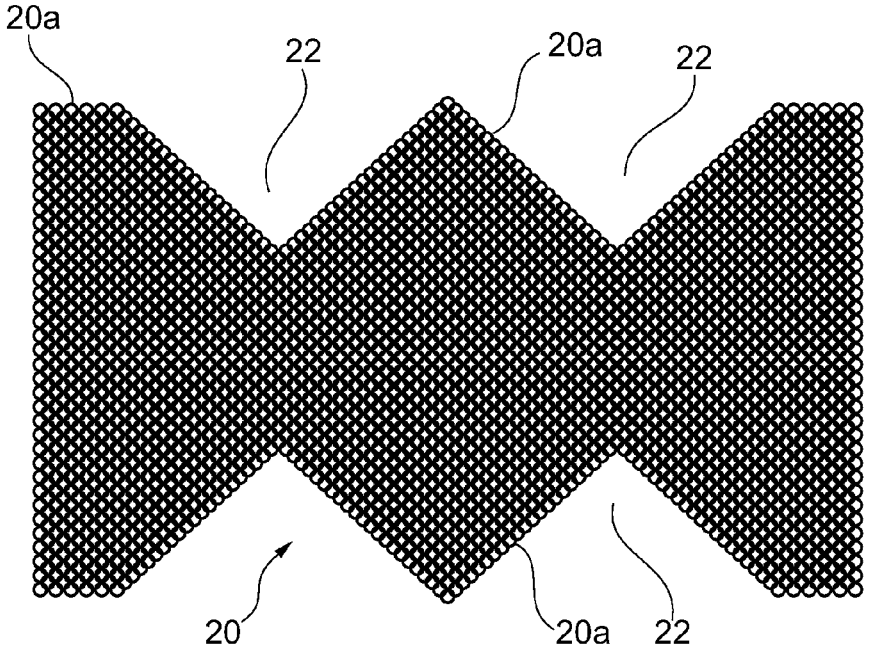
Figure 5:
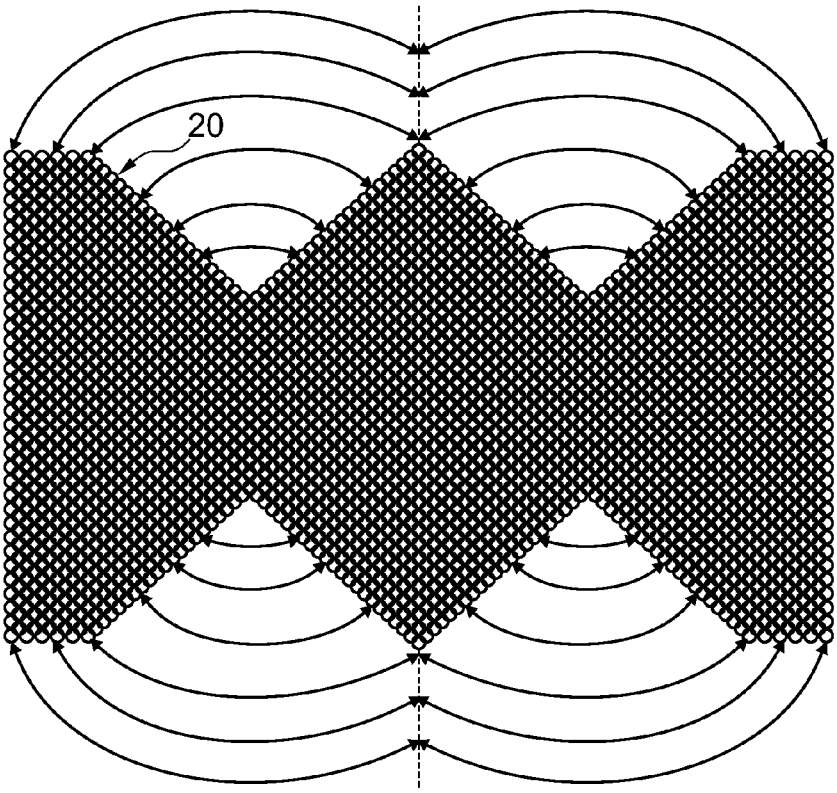

In the case of a shape which is outwardly rounded resp. rounded out on both sides, a blank 20 according to FIG. 4 is used, in which indentations 22 are provided on both sides of the blank. According to FIG. 5, the edges are connected there too, as illustrated by the arrows, such that a preferably round shape is formed. The direction of extent L lies transversely to the Figure, that is to say extends from left to right.

Figure 13:
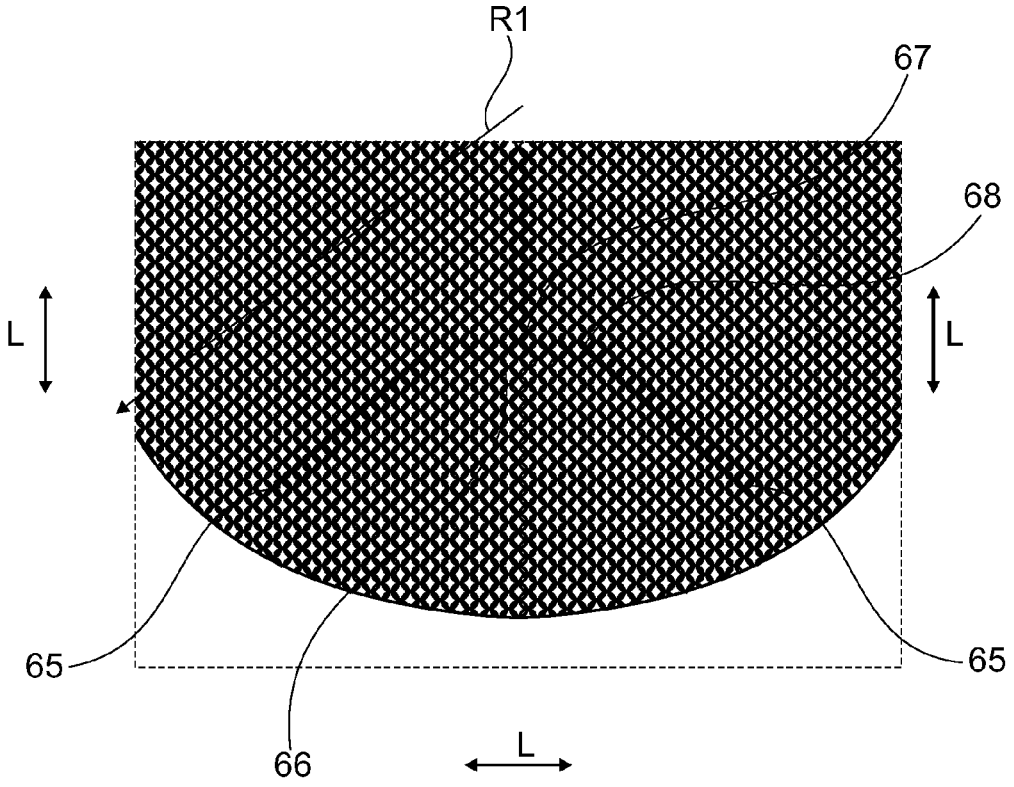
FIG. 13 shows a schematic illustration of a shape clad by means of the blank according to FIG. 12.

All the exemplary embodiments have in common the fact that the shape typically has a plurality of radii R1, of which only in FIG. 13 is a radius R1 illustrated. These radii determine the portion of the arc along which the chain mail is arranged in its direction of extent L. With different radii, this direction of extent is preferably arranged along the arc whereof the radius R1 is the larger or largest of those present at this location. Where the term "arc" is used here, this also includes curves having radii which vary in certain regions or are continuously variable, since the cladding of any three-dimensional shapes that are outwardly rounded resp. rounded out is in principle intended.

Figure 1:
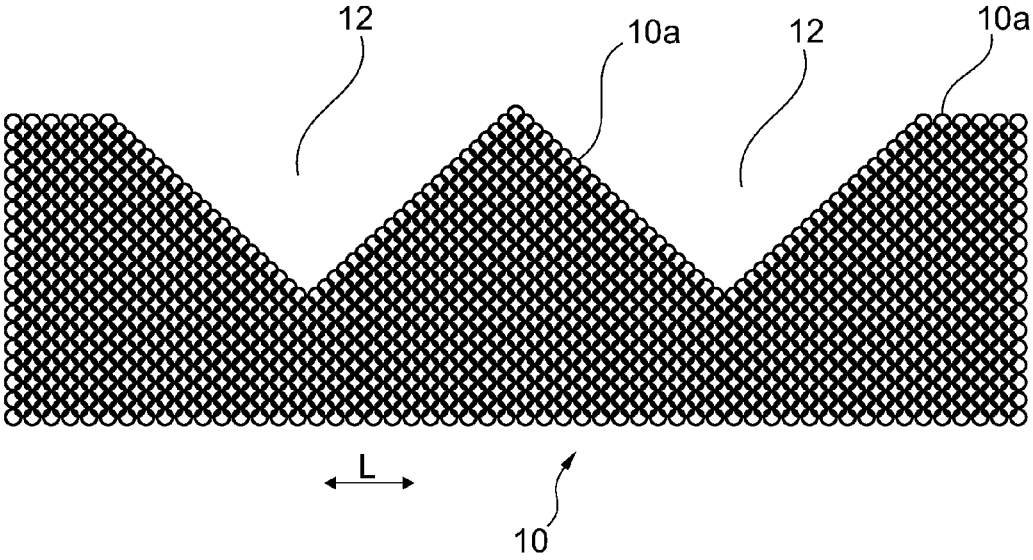
FIG. 1 a blank for cladding a pointed shape which is half-round or rounded out on one side, FIG. 2 an illustration according to FIG. 1, with the lines for connecting the edges of the blank indicated, FIG. 3 a round shape made by means of the blank according to FIG. 1, FIG. 4 a blank for cladding a pointed shape which is half-round and rounded out on both sides, FIG. 5 an illustration according to FIG. 4, with the corresponding connecting lines for illustrating the connection of the edges of the blank, FIG. 6 a blank for a shape that tapers to a point and has different radii, FIG. 7 a shape that is clad using the blank according to FIG. 6, FIG. 8 a blank for a spherical quadrant rounded shape, comprising two parts, FIG. 9 a shape clad by means of the blank according to FIG. 8, FIG. 10 a blank for cladding an overhanging rounded shape, FIG. 11 a shape clad by means of the blank according to FIG. 10, FIG. 12 a schematic illustration of a blank of a shape which is wider in certain parts.
Figure 6:
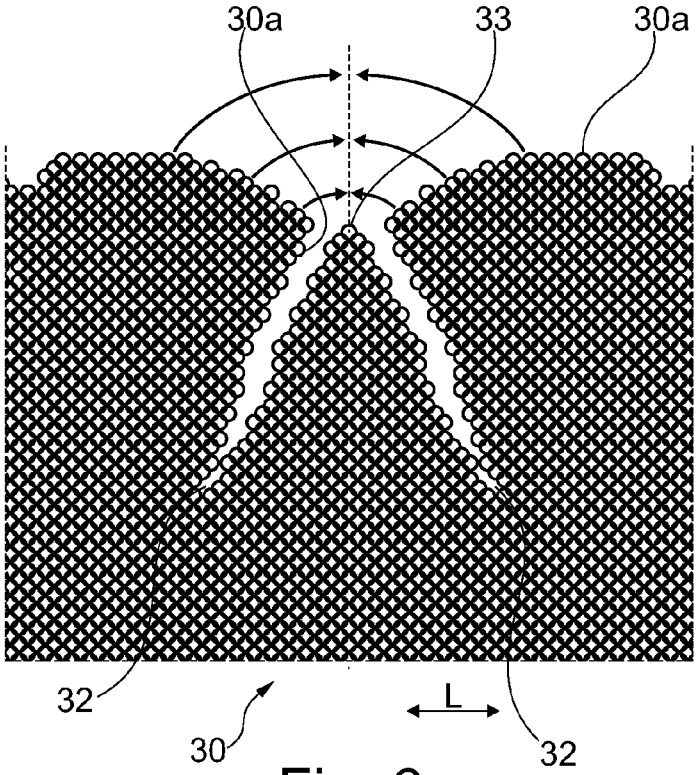
Figure 7:
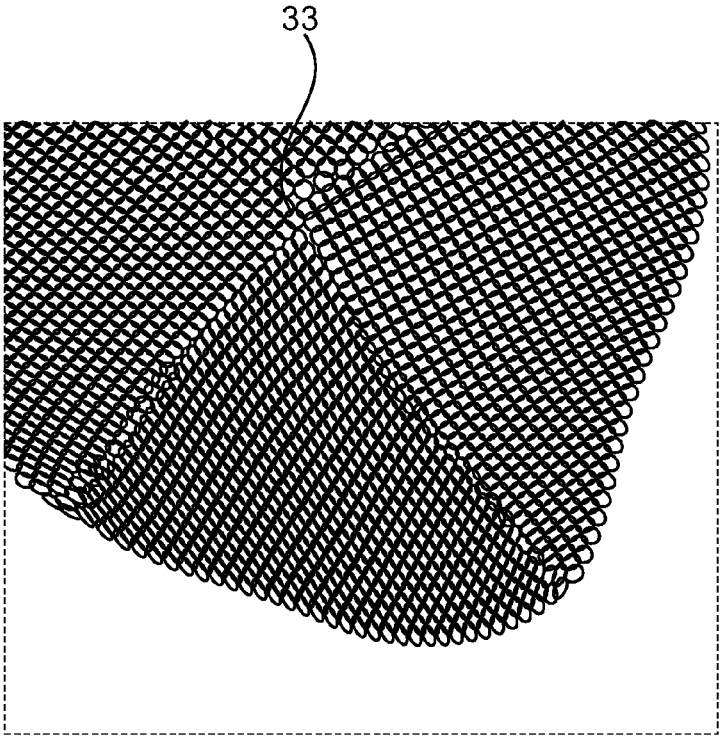

According to FIGS. 1 and 4, the indentations 12, 22 have an angle of preferably up to 90 degrees at their root, wherein, in an embodiment for forming a shape which tapers rather to an acute point, smaller angles may also be provided as illustrated in FIG. 6 for following the shape according to FIG. 7. Here, in this regard the indentations 32 are at a smaller angle. In principle, however, not only acute angles but also obtuse angles may be used for the indentations. The point 33 at the tip between the two indentations is once again found in FIG. 7. There too, sewing together is performed as indicated by the arrows in FIG. 6.

Figure 8:
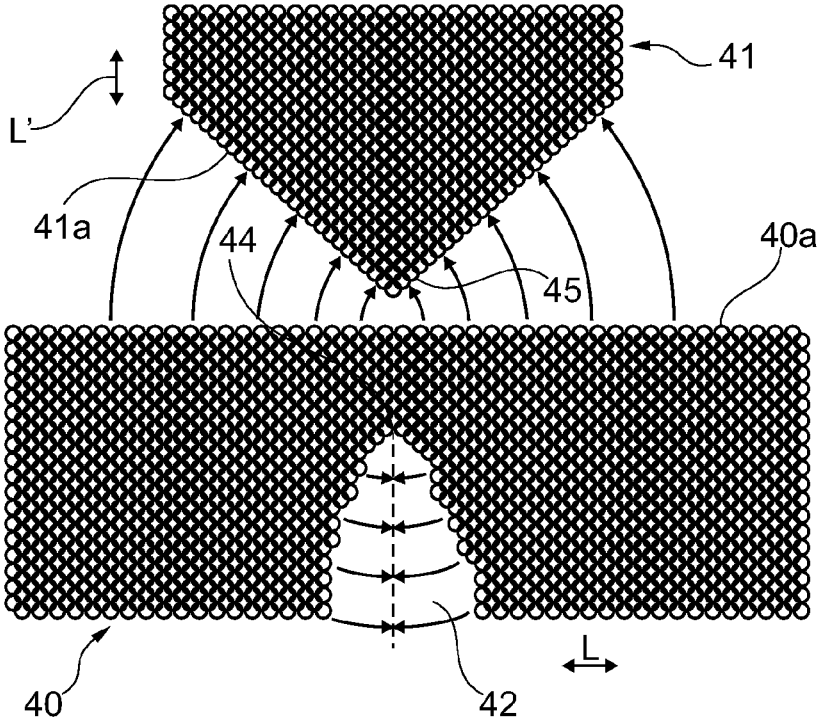
Figure 9:
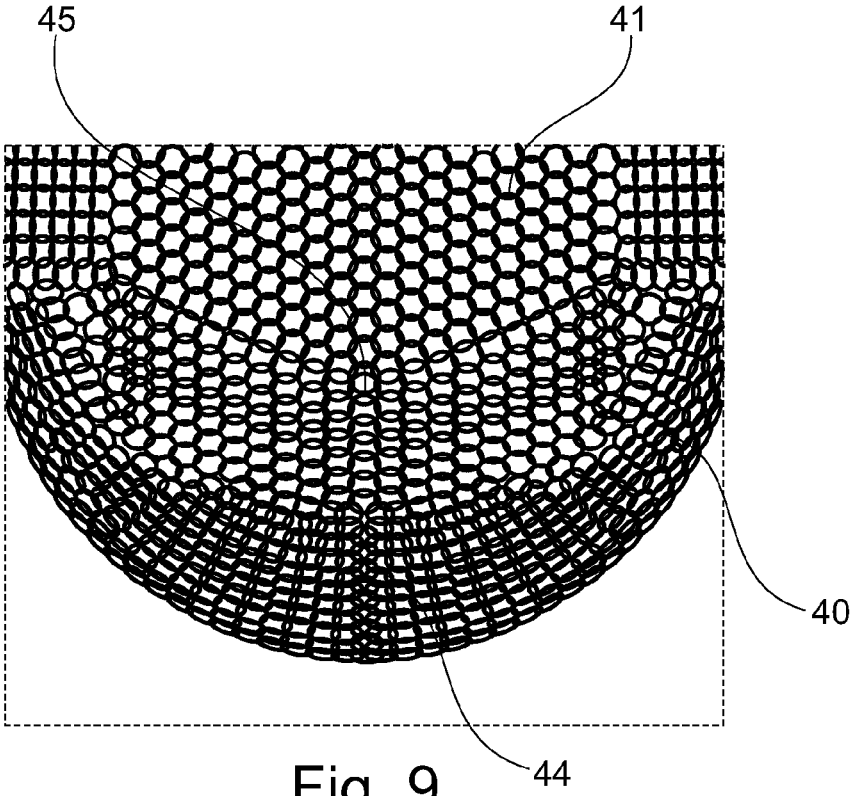

According to FIG. 4, the blank 20 has the indentations 22 on mutually opposite sides, wherein they are arranged directly opposite one another, that is to say diametrically opposed to one another. However, depending on the shape this may vary.

Where necessary, as in the exemplary embodiments according to FIGS. 8 to 11, it is also possible to connect a plurality of blanks, in the present case the blanks 40, 50 to the further blanks 41, 51, in order to clad spherical quadrant rounded shapes or overhanging rounded shapes. These two exemplary embodiments have in common the fact that the direction of extent L' of the further blank 41, 51 lies transversely and preferably at a right angle to the direction of extent L of the other blank 40, 50. Here, the further blank 41, 51 is arranged symmetrically with respect to the indentation 42, 52, on the side with the indentation (FIGS. 10. 11) or on the opposite side (FIGS. 8, 9). The blank according to FIG. 8 has a point 44 at the root of the indentation 42 and a tip 45 on the further blank 41, which are labelled accordingly in the clad shape according to FIG. 9. It can be clearly be seen at the bottom of FIG. 9 that the shape is guided backwards to the rear by the indentation 42, that is to say that it abuts properly against the basic shape in the lower region of FIG. 9. Here too, sewing together is performed as indicated by the arrows in FIG. 8.

Figure 10:
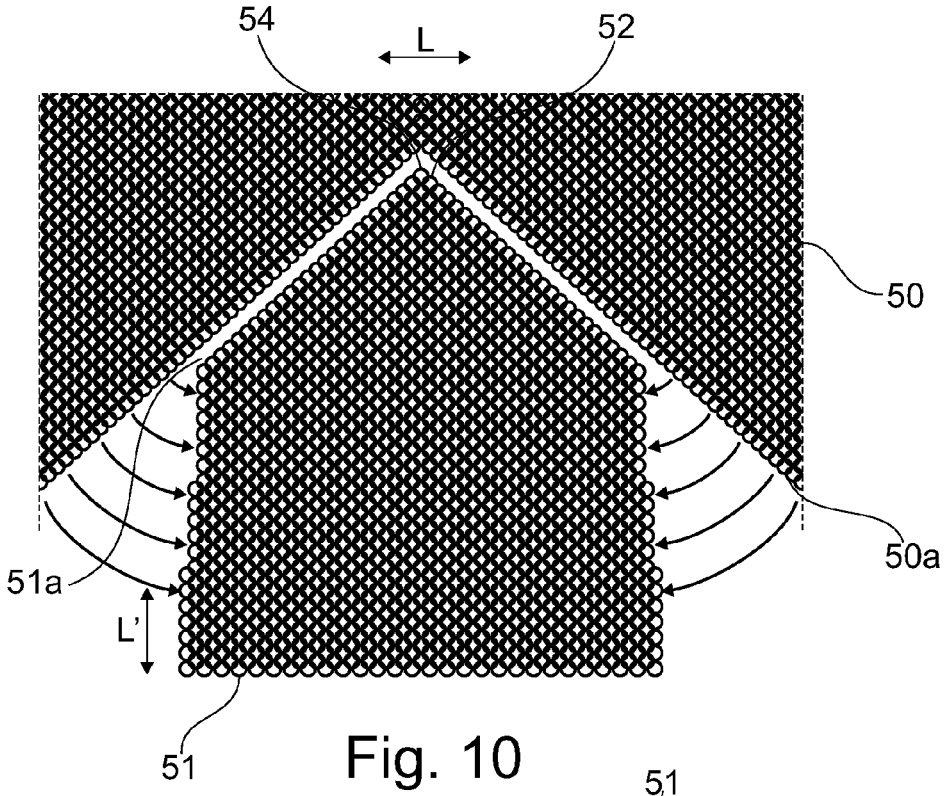
Figure 11:
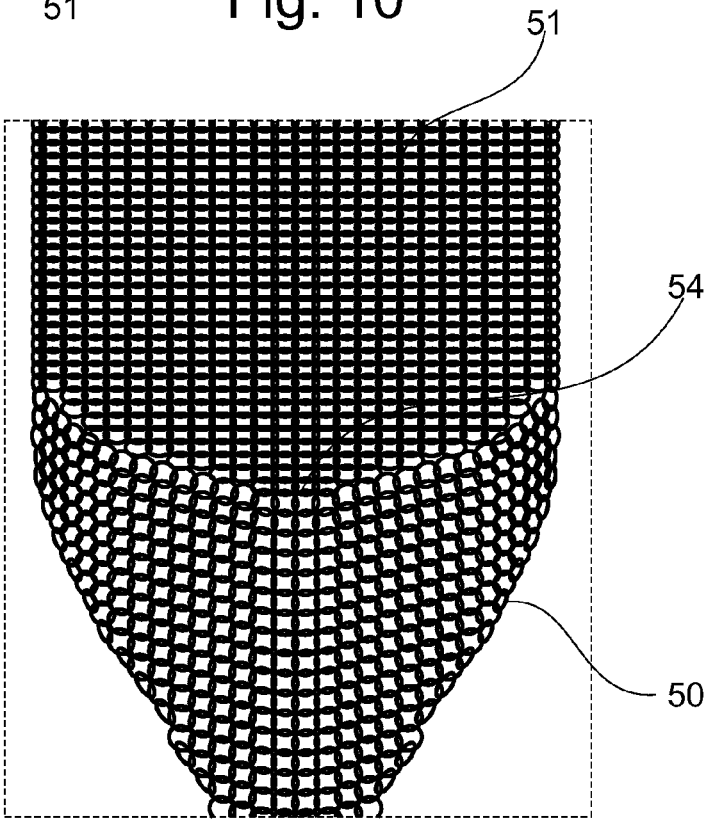

A comparable shape can be produced by the blank according to FIG. 10, in which the further blank 51 penetrates the indentation 52 and is sewn there. According to FIG. 10, sewing together is performed as indicated by the arrows. The point 54 at the root of the indentation 52 can be seen in FIG. 11.

Figure 12:
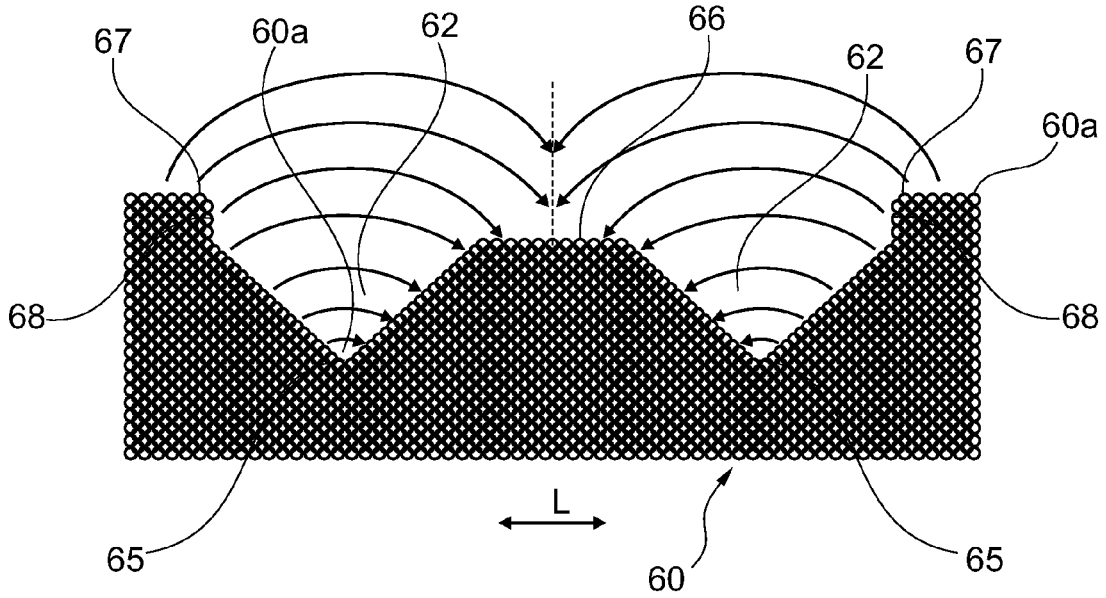

If there is a desire for wider basic shapes which have sharply different radii, an embodiment according to FIGS. 12 and 13 is advantageous. The blank 60 there has a plurality of indentations 62 lying next to one another. At the root of the indentations 62, points 65 are provided. If the points 65 are connected to one another, they form the base side of a trapezium which is produced by the remaining chain mail between the two indentations 62. In plan view, the upper side of the trapezium 66 is below a line formed by the two upper edge points 67 of the blank. By way of explanation: where the terms "upper" and "lower" are used here, this refers to the plane of the page in FIG. 12. Thus, if the edge points 67 are connected to one another, the upper side 66 of the trapezium lies below this notional line. FIG. 12 further shows that the indentations 62 lead down from the upper edge of the blank 60 first in a portion 68 which is at a steeper angle than the angle of the rest of the indentation 62 that is below it. The point of intersection between the portion 68 and the edge of the indentation that is below it is approximately at the level of the upper side 66 of the trapezium. Once the blank 60 is sewn together as indicated by the lines in FIG. 12, this then gives a shape as illustrated in FIG. 13.

It will be appreciated that this description can undergo the greatest variety of modifications, alterations and adaptations that are within the range of equivalents to the appended claims.

LIST OF REFERENCE NUMERALS

10, 20, 30, 40, 50, 60 Blank
41, 51 Further blank
10*a*, 20*a*, 30*a* Edge
40*a*, 50*a*, 60*a* Edge
41*a*, 51*a* Edge
12, 22, 32, 42, 52, 62 Indentation
33, 54 Tip
44 Root of the indentation
65 Point at the root of the indentation
66 Upper side of the trapezium
67 Upper edge point
68 Portion
L, L' Direction of extent
R1 Radius

The invention claimed is:

1. A cladding element made of chain mail, for cladding shapes having different radii with the chain mail,
wherein the chain mail has at least one blank which, for cladding one of the shapes, is connected at its edges or to the edges of a further blank to form a connection,
wherein the chain mail has a direction of extent in which the chain mail is less stretchable than in a transverse direction, or
the chain mail is not stretchable at all,
wherein the chain mail is arranged with its direction of extent along an arc of the one shape predetermined by a radius thereof and has indentations transversely to the direction of extent,
wherein the connection is performed along the indentations and along the edges of the blanks.

2. The cladding element according to claim 1, wherein the cladding element is formed from one blank or two blanks.

3. The cladding element according to claim 1, further comprising metal rings, and wherein the edges are connected by being sewn together by the metal rings.

4. The cladding element according to claim 1, wherein the one shape has a plurality of different radii and arcs along which the chain mail is arranged at a larger or largest of the arcs at this location and predetermined by the different radii.

5. The cladding element according to claim 1, wherein the indentations have an angle of up to 90 degrees at a root of the indentations.

6. The cladding element according to claim 1, wherein the blank has the indentations on mutually opposite sides.

7. The cladding element according to claim 1, wherein the direction of extent lies across both the blank and further blank, the direction of extent of the further blank lies transversely to the direction of extent of the blank.

8. The cladding element according to claim 1, wherein the further blank is arranged symmetrically with respect to the indentations, and on a side with the indentations or on a side opposite the indentations of the blank.

9. The cladding element according to claim 1,
wherein the blank has a plurality of the indentations located next to one another,
wherein a notional connection line between points at roots of the plurality of indentations forms a trapezium having a trapezoidal shape with the chain mail remaining between the plurality of indentations,
wherein in plan view, an upper side of the trapezium is below a notional connection line formed between upper edge points of the plurality of indentations at the edges of the blank.

10. The cladding element according to claim 9, wherein, starting from the upper edge points, the plurality of indentations form a portion which is at a steeper angle than an edge of the plurality of indentations which is below the portion,
wherein the point of intersection between the portion and the edge of the plurality of indentations that is below the portion is approximately at a level of an upper side of the trapezium.

11. The cladding element according to claim 5, wherein the indentations have an angle of 90 degrees at their root.

12. The cladding element according to claim 6, wherein the indentations are diametrically opposed to one another.

13. The cladding element according to claim 7, wherein the direction of extent of the further blank lies at a right angle to the direction of extent of the blank.

14. The cladding element according to claim 3, wherein the metal rings have a diameter equal to that of the rings of the chain mail.

15. The cladding element according to claim 1, wherein the transverse direction extends at a right angle to the direction of extent.

16. A cladding element made of chain mail, for cladding shapes having different radii with the chain mail,
wherein the chain mail has at least one blank which, for cladding one of the shapes, is connected at its edges or to the edges of a further blank,
wherein the chain mail has a direction of extent in which the chain mail is less stretchable than in a transverse direction which preferably extends at a right angle thereto or in which the chain mail is not stretchable at all,
wherein the chain mail is arranged with its direction of extent along an arc of the one shape predetermined by the radius and has indentations transversely to the direction of extent,
wherein the connection is performed along the indentations and along the edges of the blanks,
wherein the edges are connected by being sewn together by means of metal rings which preferably have a diameter of the rings of the chain mail.

17. A cladding element for cladding shapes having different radii, the cladding element comprising:
a first blank formed of chain mail for cladding the shapes and having edges, the first blank forming a connection by connecting the edges to each other or to the edges of a second blank, the chain mail having a direction of extent in which
the chain mail is less stretchable than in a transverse direction, or
the chain mail is not stretchable at all,
wherein the chain mail is arranged with the direction of extent along an arc of one of the shapes, the arc being along a radius of the one shape that is larger than another radius of the one shape, the chain mail having indentations formed to extend transversely to the direction of extent, wherein the connection is performed along the indentations and along the edges of the first blank.

18. The cladding element according to claim 17, further comprising metal rings connecting the edges of the first blank to each other or to the edges of the second blank.

19. The cladding element according to claim 18, wherein the metal rings have a diameter equal to that of rings of the chain mail.

20. The cladding element according to claim 17, wherein the first blank has adjacent indentations of the indentations located next to one another, wherein a notional connection line between points at roots of the adjacent indentations forms a trapezium having a trapezoidal shape with the chain mail remaining between the adjacent indentations, wherein in a plan view, an upper side of the trapezium is below a notional connection line formed between upper edge points of the adjacent indentations at the edges of the first blank.

* * * * *